US007486031B2

(12) United States Patent
Venkit et al.

(10) Patent No.: US 7,486,031 B2
(45) Date of Patent: Feb. 3, 2009

(54) SYMMETRIC CANCELLING ANTI-STRIATION CIRCUIT

(75) Inventors: Sree Venkit, Naperville, IL (US); Ramakrishnan Venkatraman, Aurora, IL (US); Amr Ghazala, Warren, NJ (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 385 days.

(21) Appl. No.: 10/537,008

(22) PCT Filed: Nov. 18, 2003

(86) PCT No.: PCT/IB03/05228

§ 371 (c)(1),
(2), (4) Date: May 25, 2005

(87) PCT Pub. No.: WO2004/049768

PCT Pub. Date: Jun. 10, 2004

(65) Prior Publication Data

US 2006/0097666 A1 May 11, 2006

Related U.S. Application Data

(60) Provisional application No. 60/429,706, filed on Nov. 27, 2002, provisional application No. 60/474,829, filed on May 30, 2003.

(51) Int. Cl.
*H05B 37/02* (2006.01)

(52) U.S. Cl. ..... 315/291; 315/209 R; 315/312

(58) Field of Classification Search ..... 315/209 R, 315/224–225, 291, 307–308, 312, DIG. 5
See application file for complete search history.

(56) References Cited

U.S. PATENT DOCUMENTS

| | | | | |
|---|---|---|---|---|
| 5,034,660 | A | 7/1991 | Sairanen | 315/174 |
| 5,192,896 | A * | 3/1993 | Qin | 315/224 |
| 5,701,059 | A * | 12/1997 | Steigerwald et al. | 315/219 |
| 5,841,239 | A * | 11/1998 | Sullivan et al. | 315/219 |
| 5,982,111 | A * | 11/1999 | Moisin | 315/283 |
| 6,008,592 | A * | 12/1999 | Ribarich | 315/225 |
| 6,069,453 | A * | 5/2000 | Arts et al. | 315/209 R |
| 6,281,641 | B1 * | 8/2001 | Chen et al. | 315/307 |
| 6,465,972 | B1 * | 10/2002 | Kachmarik et al. | 315/209 R |
| 6,756,747 | B2 * | 6/2004 | Hsieh | 315/291 |
| 6,836,077 | B2 * | 12/2004 | Nerone | 315/209 R |
| 2002/0105283 | A1 * | 8/2002 | Murakami et al. | 315/224 |
| 2003/0015970 | A1 * | 1/2003 | Nerone | 315/291 |
| 2004/0085031 | A1 * | 5/2004 | Hsieh | 315/291 |
| 2005/0168171 | A1 * | 8/2005 | Poehlman | 315/291 |

FOREIGN PATENT DOCUMENTS

| | | |
|---|---|---|
| EP | 0547674 A1 | 12/1992 |
| WO | WO 97/43879 | 11/1997 |
| WO | WO 98/09484 | 3/1998 |

* cited by examiner

*Primary Examiner*—David Hung Vu
*Assistant Examiner*—Tung X Le

(57) ABSTRACT

A striation correction circuit 300 is arranged to apply a first striation correction current to the first fluorescent lamp L1 and a second striation correction current to the second fluorescent lamp L2. A first voltage appearing across the first fluorescent tube L1 due to the first striation correction current is substantially similar in magnitude but has inverted polarity with respect to a second voltage across the second fluorescent tube L2 due to the second striation correction current. Detection of an end-of-life condition of a fluorescent lamp is facilitated.

22 Claims, 4 Drawing Sheets

SYMMETRIC CANCELLING ANTI-STRIATION CIRCUIT

CROSS REFERENCE TO RELATED APPLICATION

This application claims the benefit of U.S. provisional application Ser. No. 60/429,706 filed Nov. 27, 2002, and U.S. provisional application Ser. No. 60/474,829 filed May 30, 2003 which is incorporated herein by reference.

The invention relates to fluorescent lamp driving circuits. More particularly the invention relates to improved techniques for configuring a two-lamp fluorescent lamp for end-of-life detection with an anti-striation circuit.

In the field of fluorescent lamps it is known that some lamps exhibit striations when dimmed to very low levels. One way to remove the striations is to inject a small DC component into a lamp driving current. Some lamps with a small diameter require ballasts having an end-of-life (EOL) detection circuit. A fluorescent lamp tube nearing failure will typically exhibit a fluctuation in impedance that will appear to a detection circuit. As a lamp begins to fail, the EOL circuit senses a change in the DC voltage at the lamp. However, the impedance of a lamp operated at low light output levels is much higher than the lamp impedance of full brightness operation. Therefore, even a small DC current multiplied by the lamp impedance may result in a significant voltage. The EOL circuit cannot distinguish between a lamp voltage due to low-light lamp operation and a voltage change due to an impending lamp failure. An erroneous shut down of the ballast may then be triggered by the EOL sensing circuit. The EOL detection is even less reliable with series connected two lamp configurations, particularly when the lamps have a higher voltage at low dim levels since the lamp voltages will add.

FIG. 1 shows a circuit diagram for an anti-striation circuit for a series-connected two-lamp configuration having end-of-life detection. An isolation transformer T1 couples power to a series connected two-lamp load L1 and L2. A resistor R1 and a diode D1 across the load provide an anti-striation circuit for dimmed operation. A small DC current (Idc), is injected into the load by the voltage drop across R1. A capacitor C1 senses a change in the potential voltages VL1 and VL2 across the lamps. The scalar impedance of each lamp RL1, RL2, for lamps L1 and L2 respectively is:

$$RL=VL/Idc, \text{ and} \tag{1}$$

the net DC voltage on the capacitor is given by the relationship:

$$VL1+VL2=2*Idc*RL. \tag{2}$$

Generally, the EOL shutdown voltage level must be set higher than the expected DC voltage level resulting from dimmed lamp operation such that:

$$\text{EOL shutdown DC level}>2*Idc*RL. \tag{3}$$

It would therefore be desirable to provide an improved anti-striation circuit configuration that addressed these and other limitations.

The present invention is directed to a fluorescent lamp circuit. In accordance with the invention, a power source is selectively arranged to deliver power to a load, a first fluorescent lamp is coupled to the power source and a second fluorescent lamp coupled in series to the first fluorescent lamp and coupled to the power source. A striation correction circuit is coupled to the power source and coupled to the first and second fluorescent lamps. The striation correction circuit is arranged to apply a first striation correction current to the first fluorescent lamp and a second striation correction current to the second fluorescent lamp. A first voltage appearing across the first fluorescent tube due to the first striation correction current is substantially similar in magnitude but has inverted polarity with respect to a second voltage across the second fluorescent tube due to the second striation correction current.

In accordance with another aspect of the invention, a method of reducing striations in a fluorescent lighting circuit is provided. A first striation correction current and a second striation correction current are generated. The first striation correction current is applied to a first fluorescent lamp. The second striation correction current is applied to a second fluorescent lamp. The first fluorescent lamp and the second fluorescent lamp are coupled in series. A first voltage appearing across the first fluorescent lamp due to the first striation correction current is substantially similar in magnitude but has inverted polarity with respect to a second voltage appearing across the second fluorescent lamp due to the second striation correction current.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

In the following description the term "coupled" means either a direct connection between the things that are connected, or a connection through one or more active or passive devices that may or may not be shown, as clarity dictates.

Figure 1:
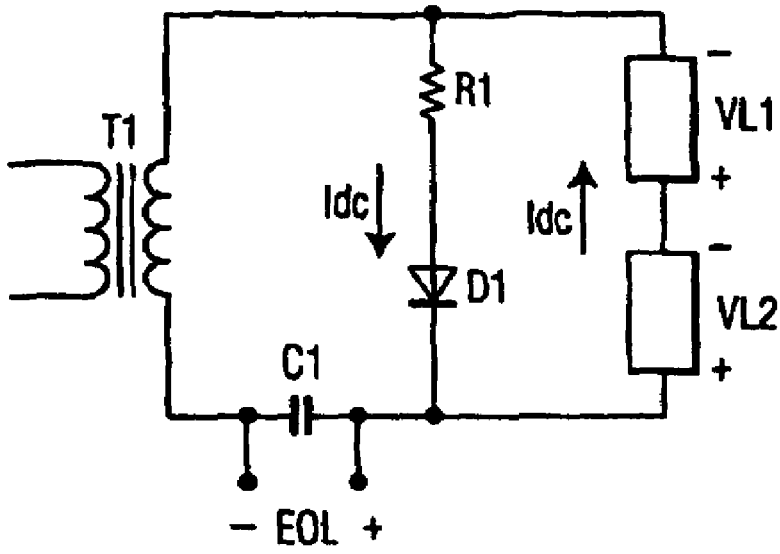
FIG. 1 illustrates a prior art anti-striation circuit for a fluorescent lamp ballast having end-of-life detection.
Figure 2:
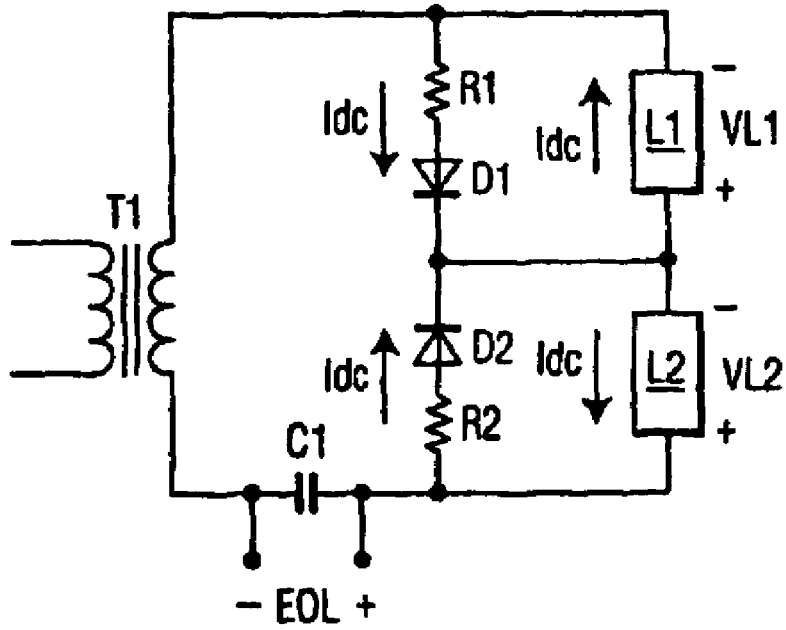
FIG. 2 illustrates a fluorescent lamp circuit having a striation correction circuit and end-of-life detection in accordance with the invention.

FIG. 2 illustrates a fluorescent lamp circuit having a striation correction circuit and end-of-life detection in accordance with the invention. FIG. 2 shows an isolation transformer T1 coupled to a closed-loop circuit comprising: a capacitor C1; a striation correction circuit further comprising a first lamp correction circuit having a diode D1 in series with a resistor R1, and a second lamp correction circuit having a diode D2 in series with a resistor R2; and, first and second series-coupled fluorescent lamps, L1 and L2. The first and second lamp correction circuits are coupled in series with the diodes, D1 and D2, opposing one another in current sense. The first fluorescent lamp L1 is shown in parallel with the first lamp correction circuit, D1 and R1. The second fluorescent lamp L2 is shown in parallel with the second lamp correction circuit, D2 and R2. The capacitor C1 is shown in series with the transformer T1 and the lamp circuits.

Power is selectively coupled to the fluorescent lamp circuit through the transformer T1. A dimmable switch-mode or PWM-type ballast is generally coupled to the transformer T1 primary (not shown). The transformer T1 is typically an isolation transformer and may have one or more taps. The diodes, D1 and D2, are any suitable diodes having a power rating commensurate with the required DC striation correction currents, and typically will have the same rated values within the standard manufacturer tolerance ranges. In one embodiment (not shown), D1 and D2 are transistors configured as diodes. The resistors, R1 and R2, are any suitable resistors for providing a voltage drop to generate a DC current, and generally have the same rated value within standard manufacturing tolerance ranges. The resistors, R1 and R2, are generally metal film types, but carbon and wire wound resistors are interchangeable. In one embodiment (not shown), R1 and R2 are transistors configured as resistive loads. The fluorescent lamps, L1 and L2, are any suitable fluorescent lamps, typically of narrow diameter and dimmable. The capacitor C1 is any capacitor suitable for sensing a loop DC voltage change (EOL) due to an end-of-life condition on a fluorescent tube. In one embodiment, an EOL detection circuit is coupled to the capacitor C1 (not shown.)

In operation, a DC current Idc is induced in each lamp correction circuit by applying power to the transformer T1 primary. A voltage across the secondary of the transformer T1 causes a voltage drop across resistors R1 and R2. Symmetric DC currents are injected to the fluorescent lamps L1 and L2, due to the orientation of the diodes D1 and D2. As shown in FIG. 2, the current Idc injected to the fluorescent lamps L1 and L2 is substantially equivalent in magnitude within a tolerance range, but opposite in sense. The opposing sense of the injected current Idc causes the resulting DC voltages on the fluorescent lamps, L1 and L2, to be opposite in polarity and therefore substantially eliminated from the loop voltage. Therefore, under normal operation of the fluorescent lamp circuit, the net DC voltage on the capacitor C1 is zero. The shutdown threshold voltage for the EOL sensing circuit may be configured based upon the fluorescent lamp characteristics without regard to the striation correction circuits.

Figure 3:
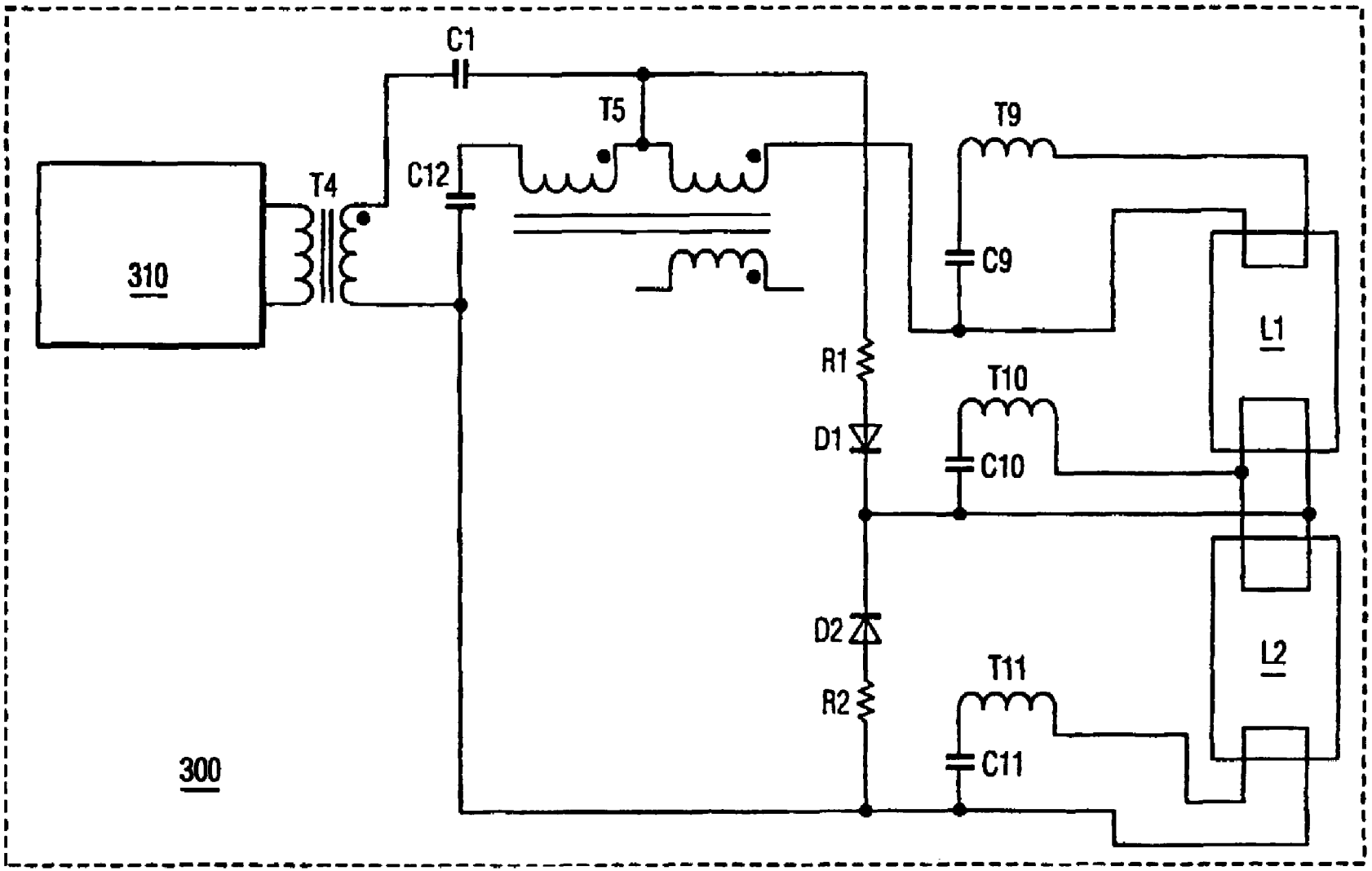
FIG. 3 illustrates a second embodiment of the fluorescent lamp circuit of FIG. 2 in accordance with the present invention.

FIG. 3 illustrates a second embodiment of the fluorescent lamp circuit of FIG. 2 in accordance with the present invention. FIG. 3 shows a fluorescent lamp circuit 300 comprising a transformer T4 coupling a ballast circuit 310 to a closed-loop circuit comprising a capacitor C1; a striation correction circuit comprising a first lamp correction circuit having a diode D1 in series with a resistor R1 and a second lamp correction circuit having a diode D2 in series with a resistor R2; first and second series-coupled fluorescent lamps, L1 and L2; and, an EOL detection circuit comprising current sense transformer T5, capacitors C9, C10, and C11 and C12, and, transformers T9, T10, T11. The first and second lamp correction circuits are coupled in series with the diodes, D1 and D2, opposing one another in current sense. The first fluorescent lamp L1 is shown in parallel with the first lamp correction circuit, D1 and R1. The second fluorescent lamp L2 is shown in parallel with the second lamp correction circuit, D2 and R2. The capacitor C1 is shown in series with the transformer T1 and the lamp correction circuits. Capacitor C12 is shown coupled in series to the current sense transformer T5. Capacitor C9 and transformer T9 are shown in series with the current sense transformer T5 and a first end of the first fluorescent lamp L1. Capacitor C10 and transformer T10 are shown in series with the lamp correction circuits and a second end of the first fluorescent lamp L1 and a first end of the second fluorescent lamp L2. Capacitor C11 and transformer T11 are shown in series with the current sense transformer T5 and a second end of the second fluorescent lamp L2. In one embodiment (not shown), additional components such as current sources, pass transistors and bias resistors are included in fluorescent lamp circuit 300. EOL detection circuits will be known to those skilled in the art and will not be further discussed.

In operation, the fluorescent lamp circuit 300 provides fluorescent lamp striation correction for dimmed operation and reliable end-of-life detection. As in FIG. 2, a DC current Idc is induced in each lamp correction circuit by applying power to the transformer T4 primary. A voltage across the secondary of the transformer T1 causes a voltage drop across resistors R1 and R2. Symmetric DC currents are injected to the fluorescent lamps L1 and L2. The current Idc injected to the fluorescent lamps, L1 and L2, is substantially equivalent in magnitude within a tolerance range, but opposite in sense. The opposing sense of the injected current Idc causes the resulting DC voltages on the fluorescent lamps, L1 and L2, to be opposite in polarity and therefore substantially eliminated from the loop voltage. Therefore, under normal operation of the fluorescent lamp circuit 300, the net DC voltage on the capacitor C1 is zero. The shutdown threshold voltage for the EOL sensing circuit may be configured based upon the fluorescent lamp characteristics without regard to the striation correction circuits. In one embodiment (not shown), two or more fluorescent lamp circuits 300 may be configured for parallel operation with a combined power source.

Figure 4:
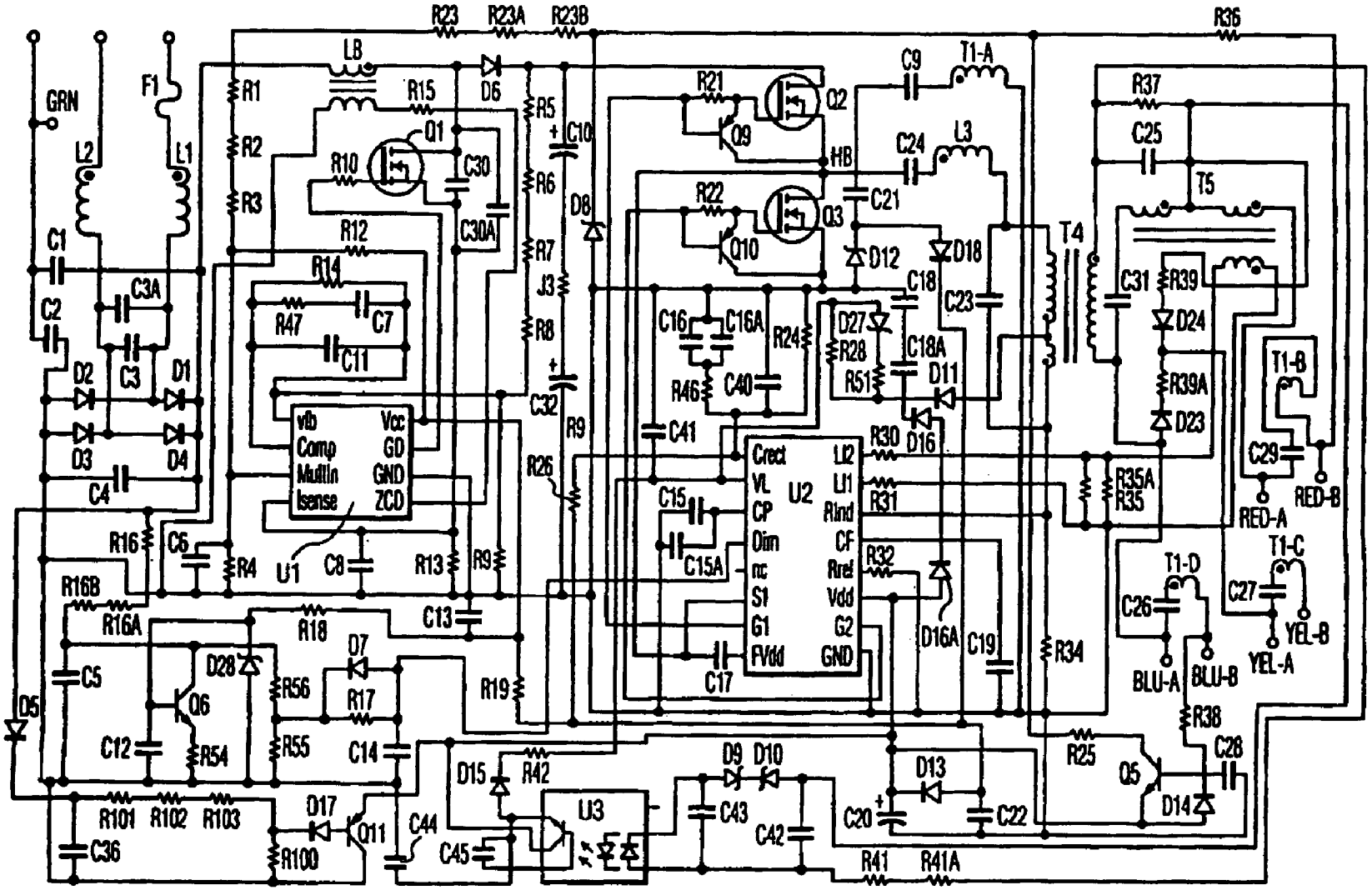
FIG. 4 illustrates another embodiment of a fluorescent lamp circuit as in FIGS. 2 and 3.

FIG. 4 illustrates yet another embodiment of a fluorescent lamp circuit as in FIGS. 2 and 3. In particular, FIG. 4 shows a detailed schematic including an embodiment of a fluorescent lamp circuit as implemented in FIG. 3. A skilled practitioner will recognize components of a standard ballast circuit depicted in FIG. 4. The design and operation of ballast circuits is known to skilled practitioners and therefore the components and operation of the ballast circuit portions of FIG. 4 will not be discussed. Of relevance to the present invention in FIG. 4 is a striation correction circuit comprising a first lamp correction circuit having a diode D24 in series with a resistor R38 and a second lamp correction circuit having a diode D23 in series with a resistor R38A; an EOL detection circuit comprising current sense transformer T5, capacitors C27, C28, and C29 and, transformers T1-C, T1-8, T1-9. The first and second lamp circuits are coupled in series with the diodes, D24 and D23, opposing one another in current sense. The first fluorescent lamp resides between terminals RED-A-RED-B and YEL-A-YEL-B which is shown in parallel with the first lamp correction circuit, D24 and R38. The second fluorescent lamp resides between terminals YEL-A-YEL-B and BLU-A-BLU-B which is shown in parallel with the second lamp correction circuit, D23 and R38A. The capacitor C25 is shown in series with the transformer T4 and the lamp correction circuits. Capacitor C31 is shown coupled in series to the current sense transformer T5. Capacitor C29 and transformer T1-9 are shown in series with the current sense transformer T5 and a first end of the first fluorescent lamp L1. Capacitor C27 and transformer T1-C are shown in series with the lamp correction circuits and a second end of the first fluorescent lamp L1 and a first end of the second fluorescent lamp L2. Capacitor C26 and transformer T1-9 are shown in series with the current sense transformer T5 and a second end of the second fluorescent lamp L2. Additional components such as current sources, pass transistors and bias resistors included in fluorescent lamp circuit will be understood by the skilled practitioner and will not be discussed.

In the following process description certain steps may be combined, performed simultaneously, or in a different order.

Figure 5:
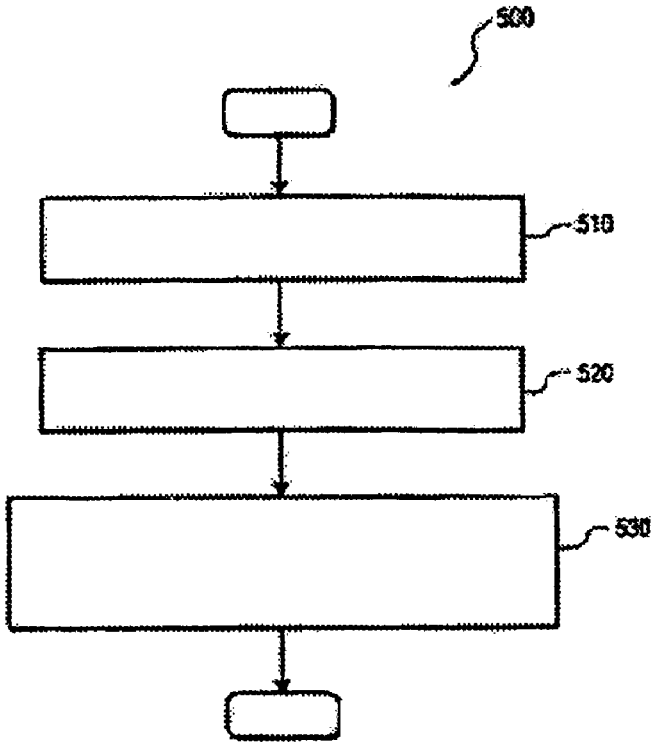
FIG. 5 is a flow diagram of a method for reducing striations in a fluorescent lamp system.

FIG. 5 is a flow diagram of a method for reducing striations in a fluorescent lamp system. Process 500 begins in step 510. In step 510, a first striation correction current and a second striation correction current are generated. The striation correction currents may be created at any time power is applied to the fluorescent lamp system. Generally, the first and second striation correction currents are simultaneously generated responsive to the application of a power source, as in the voltage drop across resistors R1 and R2. The striation correction currents are DC currents of a magnitude that reduces striations in fluorescent lamps operated at low light levels. In one embodiment, generation of the striation correction currents is selectably controlled based on the operational status of the fluorescent lamp. For instance, detection of an end-of-life condition by an EOL circuit such as described in FIGS. 3 and 4 may trigger a shut down of the striation correction current generation. In another embodiment, generation of the striation correction currents is selectably controlled based on the light output configuration of the lamp. For instance, selection of normal light level lamp operation may trigger a shutdown of striation correction current generation, whereas selection of low light level lamp operation may trigger striation correction current generation.

In step 520, the first striation correction current is applied to a first fluorescent lamp L1. Application of the first striation correction current may occur at any time during or after generation of the correction current. Typically, application of the first striation correction current is concurrent with current generation.

In step 530, the second striation correction current is applied to a second fluorescent lamp L2. Application of the second striation correction current may occur at any time during or after generation. Typically, application of the second striation correction current is concurrent with both generation of the second striation current and generation and application of the first striation correction current. The second striation correction current is applied in an opposite sense to the application of the first striation correction current such that a first voltage appearing across the first fluorescent lamp L1 resulting from the first striation correction current is substantially similar in magnitude and having inverted polarity with respect to a second voltage across the second fluorescent tube L2 resulting from the second striation correction current.

Figure 6:
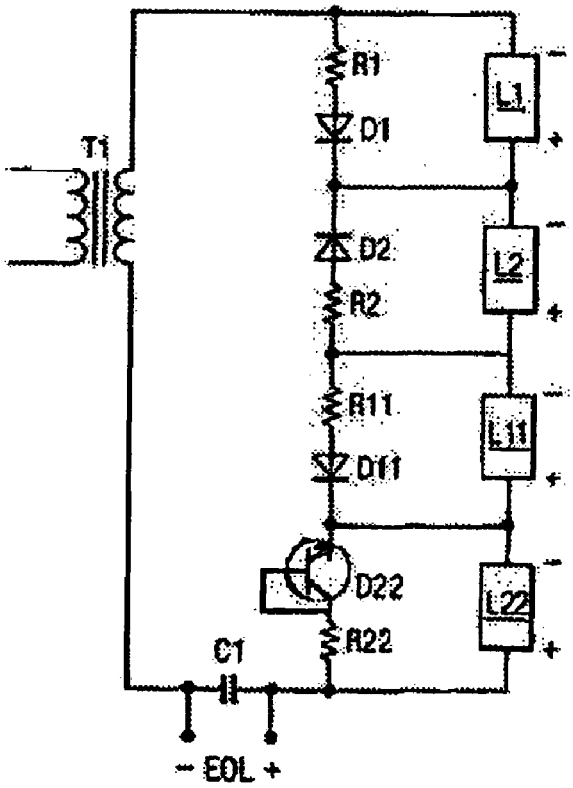
FIG. 6 illustrates another embodiment of a fluorescent lamp circuit as in FIG. 2 in accordance with the present invention.

FIG. 6 illustrates another embodiment of a fluorescent lamp circuit as in FIG. 2 in accordance with the present invention. FIG. 6 shows one pair of fluorescent lamps L1, L2, with an additional pair of fluorescent lamps L11, L22 arranged in series with the pair of fluorescent lamps L1, L2. An additional striation correction circuit including resistors R11, R22 and diodes D11, D22 corresponds to the additional pair of fluorescent lamps L11, L22. The additional pair of fluorescent lamps L11, L22 and additional striation correction circuit including resistors R11 , R22 and diodes D11, D22 are all coupled to isolation transformer T1 and the power source, In this example, the lamp correction circuit including resistor R22 and diode 22 includes the diode D22 as a transistor.

While the preferred embodiments of the invention have been shown and described, numerous variations and alternative embodiments will occur to those skilled in the art. Accordingly, it is intended that the invention be limited only in terms of the appended claims.

The invention claimed is:

1. A fluorescent lamp circuit, comprising:

a power source selectively arranged to deliver power to a load;

a first fluorescent lamp coupled to the power source;

a second fluorescent lamp coupled in series to the first fluorescent lamp and coupled to the power source;

an end-of-life detection circuit coupled to the first and second fluorescent lamps; and a striation correction circuit coupled to the power source and coupled to the first and second fluorescent lamps that is arranged to apply a first striation correction current to the first fluorescent lamp and a second striation correction current to the second fluorescent lamp wherein a first voltage appearing across the first fluorescent lamp resulting from the first striation correction current is substantially similar in magnitude and having inverted polarity with respect to a second voltage across the second fluorescent lamp resulting from the second striation correction current.

2. The circuit of claim 1 wherein the end-of-life detection circuit comprises a capacitor arranged in series with the first and second fluorescent lamps to sense voltage changes in a closed-loop circuit with the power source and the first and second fluorescent lamps.

3. The circuit of claim 2 wherein the end-of-life detection circuit further comprises a current sense transformer.

4. The circuit of claim 2 wherein net DC voltage on the capacitor is zero.

5. The circuit of claim 1 wherein the striation correction circuit comprises a first lamp correction circuit for generating the first striation correction current in the first fluorescent lamp and a second lamp correction circuit for generating the second striation correction current in the second fluorescent lamp.

6. The circuit of claim 5 wherein the first lamp correction circuit is arranged in parallel with the first lamp and the second lamp correction circuit is arranged in parallel with the second lamp and wherein the first and second lamp circuits are in series.

7. The circuit of claim 6 wherein the first lamp correction circuit and the second lamp correction circuit each comprise a diode in series with a resistor and wherein the first and second lamp correction circuits are arranged symmetrically with the diodes opposing one another other.

8. The circuit of claim 5 wherein the first lamp correction circuit and the second lamp correction circuit comprises at least one transistor.

9. The circuit of claim 1 wherein the power source is a fluorescent lamp ballast coupled to the first and second fluorescent lamps through an isolation transformer.

10. The circuit of claim 1 wherein the fluorescent lamp circuit comprises at least one additional pair of fluorescent lamps and at least one additional corresponding striation correction circuit all coupled to the power source and wherein the at least one additional pair of fluorescent lamps are arranged in series with the first and second fluorescent lamps.

11. The circuit of claim 1 wherein the first and second striation correction currents are DC signals and wherein the first striation current is opposite in sense to the second striation current.

12. The circuit of claim 1 wherein the first striation correction current and the second striation correction current are substantially equivalent in magnitude.

13. A method of reducing striations in a fluorescent lighting system, comprising:

generating a first striation correction current and a second striation correction current;

applying the first striation correction current to a first fluorescent lamp;

applying the second striation correction current to a second fluorescent lamp wherein the first fluorescent lamp and the second fluorescent lamp are coupled in series and wherein a first voltage appearing across the first fluorescent lamp resulting from the first striation correction current is substantially similar in magnitude and having inverted polarity with respect to a second voltage appearing across the second fluorescent lamp resulting from the second striation correction current; and sensing a voltage change in the fluorescent lighting circuit indicative of a fluorescent tube end-of-life condition wherein an end-of life detection circuit is coupled to the first and second fluorescent lamps.

14. The method of claim 13 wherein the end-of-life detection circuit comprises a capacitor arranged in series with the first and second fluorescent lamps.

15. The method of claim 13 wherein a striation correction circuit comprises a first lamp correction circuit for generating the first striation correction current in the first fluorescent lamp and a second lamp correction circuit for generating the second striation correction current in the second fluorescent lamp.

16. The method of claim 15 wherein the first lamp correction circuit is arranged in parallel with the first lamp and the second lamp correction circuit is arranged in parallel with the second lamp and wherein the first and second lamp correction circuits are in series.

17. The method of claim 16 wherein the first lamp correction circuit and the second lamp correction circuit each comprise a diode in series with a resistor and wherein the first and second lamp correction circuits are arranged symmetrically with the diodes opposing one another other.

18. The method of claim 16 wherein the first lamp correction circuit and the second lamp correction circuit are comprised of at least one component selected from the group consisting of a transistor, a resistor, a diode, a capacitor and an inductor.

19. The method of claim 13 wherein the fluorescent lamp circuit comprises at least one additional pair of fluorescent lamps and at least one additional corresponding striation correction circuit all coupled to the power source and wherein the at least one additional pair of fluorescent lamps are arranged in series with the first and second fluorescent lamps.

20. The method of claim 13 wherein the first striation correction current and the second striation correction current are substantially equivalent in magnitude.

21. A system for reducing striations in a multi-tube fluorescent lamp assembly, comprising:

means for generating a first striation correction current and a second striation correction current;

means for applying the first striation correction current to a first fluorescent lamp;

means for applying the second striation correction current to a second fluorescent lamp; and means for sensing a voltage change in the fluorescent lighting circuit indicative of a fluorescent tube end-of-life condition wherein an end-of-life detection circuit is coupled to the first and second fluorescent lamps;

wherein the first fluorescent lamp and the second fluorescent lamp are coupled in series and wherein a first voltage appearing across the first fluorescent lamp resulting from the first striation correction current is substantially equal in magnitude and having inverted polarity with respect to a second voltage appearing across the second fluorescent lamp resulting from the second striation correction current.

22. The system of claim 21 wherein the first striation correction current and the second striation correction current are substantially equivalent in magnitude.

* * * * *